US008405596B2

(12) United States Patent
Kumada

(10) Patent No.: US 8,405,596 B2
(45) Date of Patent: Mar. 26, 2013

(54) DISPLAY DEVICE HAVING DUAL SCANNING SIGNAL LINE DRIVER CIRCUITS

(75) Inventor: Kouji Kumada, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 927 days.

(21) Appl. No.: 12/312,782

(22) PCT Filed: Nov. 12, 2007

(86) PCT No.: PCT/JP2007/071917

§ 371 (c)(1),
(2), (4) Date: May 27, 2009

(87) PCT Pub. No.: WO2008/093458

PCT Pub. Date: Aug. 7, 2008

(65) Prior Publication Data

US 2010/0066922 A1 Mar. 18, 2010

(30) Foreign Application Priority Data

Jan. 31, 2007 (JP) ..... 2007-20399

(51) Int. Cl.
*G09G 3/36* (2006.01)

(52) U.S. Cl. ..... 345/100; 345/98

(58) Field of Classification Search ..... None
See application file for complete search history.

(56) References Cited

U.S. PATENT DOCUMENTS

| | | | | |
|---|---|---|---|---|
| 6,356,099 | B1 * | 3/2002 | Lee et al. | 326/24 |
| 2002/0000965 | A1 | 1/2002 | Ando et al. | |
| 2002/0075248 | A1 | 6/2002 | Morita et al. | |
| 2004/0008072 | A1 * | 1/2004 | Kimura et al. | 327/404 |
| 2004/0041769 | A1 | 3/2004 | Yamashita et al. | |
| 2005/0168491 | A1 * | 8/2005 | Takahara et al. | 345/690 |
| 2006/0187166 | A1 * | 8/2006 | Azami | 345/95 |
| 2006/0244391 | A1 * | 11/2006 | Shishido et al. | 315/169.3 |

FOREIGN PATENT DOCUMENTS

JP 2000-276110 10/2000

* cited by examiner

*Primary Examiner* — Alexander S Beck
*Assistant Examiner* — Kirk Hermann
(74) *Attorney, Agent, or Firm* — Harness, Dickey & Pierce

(57) ABSTRACT

The display device includes first and second gate driver circuits. Each gate driver circuit including a shift register and a plurality of amplifier circuits connected to one end of a gate line. The first and second gate driver circuits respectively have only a first and a second non-complementary switch provided in a last stage of their amplifier circuits, where at least one of the first and second switches is an NMOS switch or a PMOS switch. As a result, a display device is provided, which has driver circuits arranged in a well-balanced manner to achieve a left-right symmetrical display area.

14 Claims, 11 Drawing Sheets

DISPLAY DEVICE HAVING DUAL SCANNING SIGNAL LINE DRIVER CIRCUITS

TECHNICAL FIELD

The present invention relates to matrix-type display devices such as liquid crystal display devices.

BACKGROUND ART

There are several kinds of TFT (Thin Film Transistor) liquid crystal panels, including amorphous silicon TFT liquid crystal panels with low electron mobility, and polysilicon TFT liquid crystal panels with relatively high electron mobility. To reduce cost and improve reliability, some polysilicon TFT liquid crystal panels and the like have a portion of a driver circuit formed thereon taking account of the characteristic mentioned above. Gate driver circuits, which, among all driver circuits, operate at relatively low speed, can be readily formed on the liquid crystal panel.

FIG. 13 is a diagram illustrating the configuration of a conventional liquid crystal display device. In the liquid crystal display device shown in FIG. 13, a pixel array 91 and a gate driver circuit 94 are formed on a liquid crystal panel 90, and a control circuit 92 and a source driver circuit 93 are provided outside the liquid crystal panel 90. In FIG. 13, the gate driver circuit 94 is positioned to the left of the pixel array 91 on the liquid crystal panel 90. There may or may not be some circuit positioned to the right of the pixel array 91.

FIG. 14 is a diagram illustrating in detail the gate driver circuit of the liquid crystal display device shown in FIG. 13. As shown in FIG. 14, the gate driver circuit includes a shift register 95 and a plurality of amplifier circuits 96. The amplifier circuits 96 amplify outputs from the shift register 95, thereby driving gate lines provided in the pixel array 91. In conventional liquid crystal display devices, the amplifier circuits 96 are configured by connecting a plurality of CMOS switches in multiple stages.

Note that Patent Documents 1 and 2 provide disclosures relevant to the invention of the present application, concerning gate driver circuits connected at opposite ends of gate lines.

[Patent document 1] Japanese Laid-Open Patent Publication No. 2000-276110

[Patent document 2] Japanese Laid-Open Patent Publication No. 2002-23712

DISCLOSURE OF THE INVENTION

Problems to be Solved by the Invention

However, the conventional liquid crystal display device shown in FIGS. 13 and 14 has the following problems. First, formation of the driver circuit on the liquid crystal panel increases the outside dimensions of the panel correspondingly, and therefore it is necessary to reduce the area of the driver circuit. Many cases require reduction of, in particular, non-display areas located to the left and right of the display area.

Also, positioning the gate driver circuit 94 along one side of the pixel array 91 as shown in FIG. 13 renders the display area left-right asymmetrical on the liquid crystal panel 90. As a result, for example, in the case of using the liquid crystal panel 90 as a main display of a cell phone, the display area can only be positioned offset from the center of the cell phone, which renders the cell phone unattractive in design (see FIG. 15). In practice, to give priority to design, the side without a driver circuit is provided with the same non-display area as that formed on the side with the driver circuit.

Therefore, an objective of the present invention is to provide a display device having driver circuits arranged in a well-balanced manner to achieve a left-right symmetrical display area.

Solution to the Problems

A first aspect of the present invention is directed to a matrix-type display device comprising: a pixel array including a plurality of two-dimensionally arranged pixel circuits, a plurality of scanning signal lines, and a plurality of video signal lines; a first scanning signal line driver circuit connected to one end of each of the scanning signal lines and driving the scanning signal lines; a second scanning signal line driver circuit connected to the other ends of the scanning signal lines and cooperating with the first scanning signal line driver circuit to drive the scanning signal lines; and a video signal line driver circuit for driving the video signal lines, wherein, the first and second scanning signal line driver circuits each include a shift register for outputting selection signals for the scanning signal lines, and a plurality of amplifier circuits configured by connecting a plurality of switches in multiple stages, the amplifier circuits amplifying and applying the outputs from the shift register to the scanning signal lines, and the first and second scanning signal line driver circuits respectively have first and second switches provided in last stages of the amplifier circuits, at least one of the first and second switches being an NMOS switch or a PMOS switch.

In a second aspect of the present invention, based on the first aspect of the invention, the first and second scanning signal line driver circuits are formed along two opposing sides of the pixel array on a display panel having the pixel array formed thereon.

In a third aspect of the present invention, based on the first aspect of the invention, the first switch is an NMOS switch, and the second switch is a PMOS switch.

In a fourth aspect of the present invention, based on the first aspect of the invention, the first switch is a CMOS switch, and the second switch is a PMOS switch.

In a fifth aspect of the present invention, based on the fourth aspect of the invention, the size of an NMOS switch included in the first switch is approximately equal to the sum of the size of a PMOS switch included in the first switch and the size of the second switch.

In a sixth aspect of the present invention, based on the first aspect of the invention, the first switch is a CMOS switch, and the second switch is an NMOS switch.

In a seventh aspect of the present invention, based on the sixth aspect of the invention, the size of a PMOS switch included in the first switch is approximately equal to the sum of the size of an NMOS switch included in the first switch and the size of the second switch.

In an eighth aspect of the present invention, based on the first aspect of the invention, PMOS and NMOS switches are alternately provided as the first switches in accordance with the order of arrangement of the scanning signal lines, such that each switch is repeated a predetermined number of times before alternating with the other, and PMOS and NMOS switches are alternately provided as the second switches in reverse order to the first switches, such that each switch is repeated the predetermined number of times before alternating with the other.

In a ninth aspect of the present invention, based on the eighth aspect of the invention, the predetermined number is 1.

In a tenth aspect of the present invention, based on the eighth aspect of the invention, the predetermined number is 2.

In an eleventh aspect of the present invention, based on the first aspect of the invention, CMOS and PMOS switches are alternately provided as the first switches in accordance with the order of arrangement of the scanning signal lines, such that each switch is repeated a predetermined number of times before alternating with the other, and CMOS and PMOS switches are alternately provided as the second switches in reverse order to the first switches, such that each switch is repeated the predetermined number of times before alternating with the other.

In a twelfth aspect of the present invention, based on the eleventh aspect of the invention, the predetermined number is 1.

In a thirteenth aspect of the present invention, based on the eleventh aspect of the invention, the predetermined number is 2.

In a fourteenth aspect of the present invention, based on the eleventh aspect of the invention, the size of an NMOS switch included in each of the CMOS switches provided as the first and second switches is approximately equal to the sum of the size of a PMOS switch included in the CMOS switch and the size of each of the PMOS switches provided as the first and second switches.

In a fifteenth aspect of the present invention, based on the first aspect of the invention, CMOS and NMOS switches are alternately provided as the first switches in accordance with the order of arrangement of the scanning signal lines, such that each switch is repeated a predetermined number of times before alternating with the other, and CMOS and NMOS switches are alternately provided as the second switches in reverse order to the first switches, such that each switch is repeated the predetermined number of times before alternating with the other.

In a sixteenth aspect of the present invention, based on the fifteenth aspect of the invention, the predetermined number is 1.

In a seventeenth aspect of the present invention, based on the fifteenth aspect of the invention, the predetermined number is 2.

In an eighteenth aspect of the present invention, based on the fifteenth aspect of the invention, the size of a PMOS switch included in each of the CMOS switches provided as the first and second switches is approximately equal to the sum of the size of an NMOS switch included in the CMOS switch and the size of each of the NMOS switches provided as the first and second switches.

A nineteenth aspect of the present invention is directed to a display panel for use in a matrix-type display device, comprising: a pixel array including a plurality of two-dimensionally arranged pixel circuits, a plurality of scanning signal lines, and a plurality of video signal lines; a first scanning signal line driver circuit connected to one end of each of the scanning signal lines and driving the scanning signal lines; and a second scanning signal line driver circuit connected to the other ends of the scanning signal lines and cooperating with the first scanning signal line driver circuit to drive the scanning signal lines, wherein, the first and second scanning signal line driver circuits each include a shift register for outputting selection signals for the scanning signal lines, and a plurality of amplifier circuits configured by connecting a plurality of switches in multiple stages, the amplifier circuits amplifying and applying the outputs from the shift register to the scanning signal lines, and the first and second scanning signal line driver circuits respectively have first and second switches provided in last stages of the amplifier circuits, at least one of the first and second switches being an NMOS switch or a PMOS switch.

Effect of the Invention

According to the first or nineteenth aspect of the present invention, single-channel MOS switches are provided in the last stages of the amplifier circuits, thereby making it possible to reduce circuit complexity of the last-stage switches as well as of other switches, while reducing display device current consumption, as compared to the case where CMOS switches are provided. Also, two scanning signal line driver circuits are provided to the left and right of the pixel array, thereby making it possible to achieve a left-right symmetrical display area.

According to the second aspect of the present invention, two scanning signal line driver circuits are formed on the display panel, thereby making it possible to achieve a compact display device. Also, the two scanning signal line driver circuits are provided on opposite sides of the pixel array on the display panel, thereby making it possible to render the display area symmetrical in a specific direction on the display panel.

According to the third aspect of the present invention, it is possible to reduce the circuit complexity of the last-stage switches in the first and second scanning signal line driver circuits to about half the conventional complexity, while also reducing the circuit complexity of other switches.

According to the fourth or sixth aspect of the present invention, it is possible to reduce the circuit complexity of the last-stage switches in the second scanning signal line driver circuit to about half the conventional complexity, while also reducing the circuit complexity of other switches. Also, given the presence of the second scanning signal line driver circuit, the switches included in the first scanning signal line driver circuit can be reduced in circuit complexity. Furthermore, by suitably selecting the size of two switches to be included in the first switch and the size of the second switch, it becomes possible to render the rising waveform of the scanning signal line steeper than its falling waveform in the fourth aspect, while it becomes possible to render the falling waveform of the scanning signal line steeper than its rising waveform in the sixth aspect.

According to the fifth or seventh aspect of the present invention, it is possible to approximately equalize the rising and falling waveforms of the scanning signal line.

According to the eighth through eighteenth aspects of the present invention, it is possible to reduce the circuit complexity of the last-stage switches in the first and second scanning signal line driver circuits to about half the conventional complexity, while also reducing the circuit complexity of other switches. Also, by alternately arranging scanning signal lines respectively having a steeply rising waveform and a steeply falling waveform, such that each scanning signal line is repeated a predetermined number of times before alternating with the other, it becomes possible to average the waveforms of the scanning signal lines. Also, it is possible to average current consumption between the two scanning signal line driver circuits. Also, in the case of display devices with varying common electrode voltage, the common electrode voltage can be changed in cycles based on the predetermined number, thereby improving image quality on the display screen.

According to the tenth, thirteenth, or seventeenth aspect of the present invention, image quality on the display screen can be improved particularly where two lines are selected simultaneously in liquid crystal display devices with a double-size display function. Also, according to the fourteenth or eighteenth aspect of the present invention, it is possible to approximately equalize the rising and falling waveforms of the scanning signal lines.

DESCRIPTION OF THE REFERENCE CHARACTERS

Figure 1:
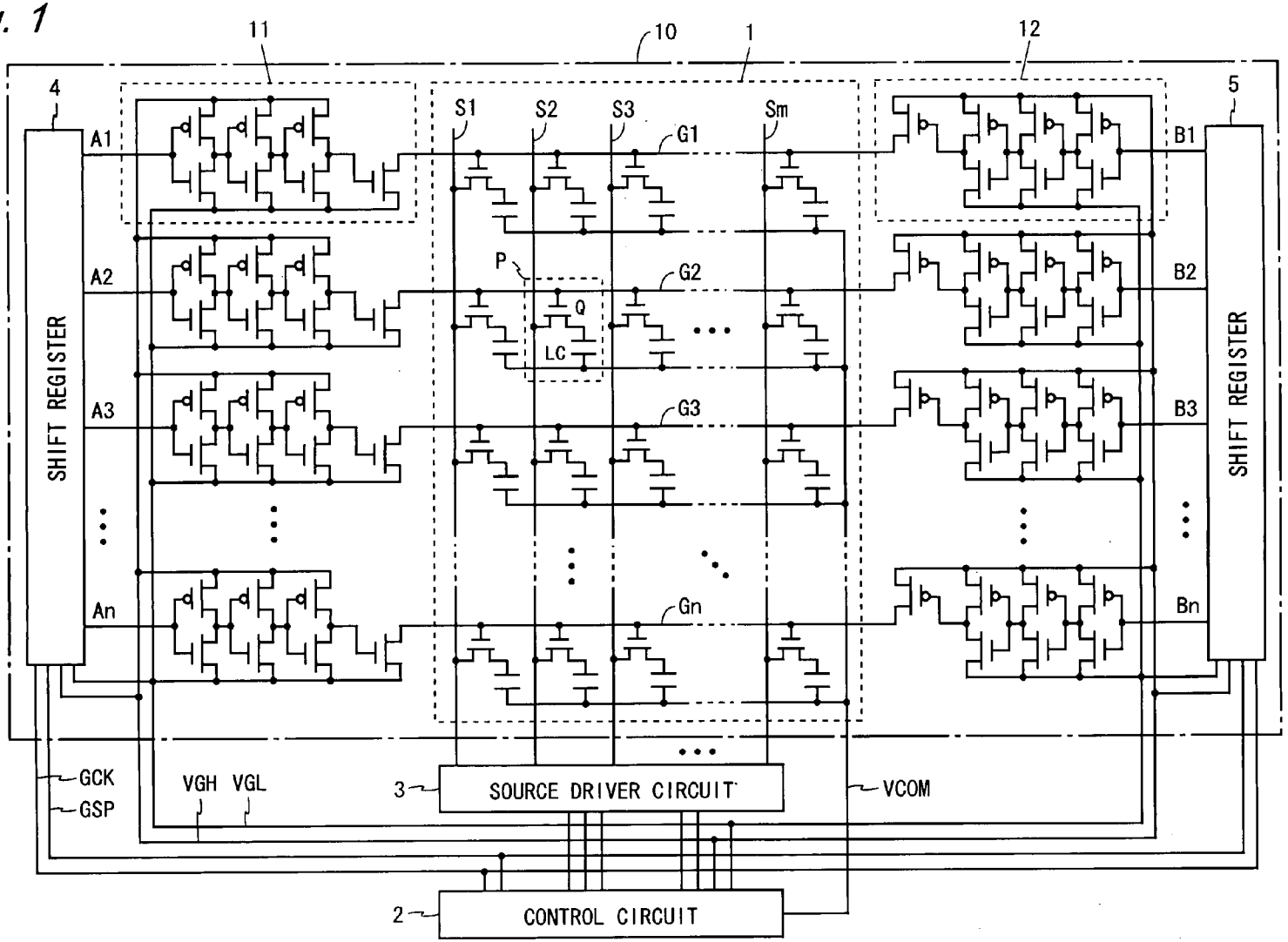
FIG. 1 is a diagram illustrating the configuration of a liquid crystal display device according to a first embodiment of the present invention.

1 pixel array
2 control circuit
3 source driver circuit
4, 5 shift register
10, 20, 30, 40, 51 to 55 liquid crystal panel
11, 12, 21, 22, 31, 32, 41, 42, 61 to 70 amplifier circuit

BEST MODE FOR CARRYING OUT THE INVENTION (First Embodiment)

FIG. 1 is a diagram illustrating the configuration of a liquid crystal display device according to a first embodiment of the present invention. The liquid crystal display device shown in FIG. 1 is provided with a pixel array 1, a control circuit 2, a source driver circuit 3, a first gate driver circuit, and a second gate driver circuit. The first gate driver circuit includes a shift register 4 and a plurality of amplifier circuits 11, and the second gate driver circuit includes a shift register 5 and a plurality of amplifier circuits 12.

Hereinafter, "m" and "n" are integers of 2 or more, and "i" is an integer from 1 to n.

The pixel array 1 includes two-dimensionally arranged (m×n) pixel circuits P, n gate lines G1 to Gn, and m data lines S1 to Sm. The pixel circuits P each include a TFT Q and a liquid crystal capacitance LC. The gate lines G1 to Gn are each commonly connected to pixel circuits P arranged in the same row, and the source lines S1 to Sm are each commonly connected to pixel circuits P arranged in the same column. Note that the gate line, the source line, the gate driver circuit, and the source driver circuit respectively correspond to "scanning signal line", "video signal line", "scanning signal line driver circuit", and "video signal line driver circuit".

Corresponding to the n gate lines G1 to Gn, the first gate driver circuit includes the n-stage shift register 4 and the n amplifier circuits 11, and the second gate driver circuit includes the n-stage shift register 5 and the n amplifier circuits 12. The first and second gate driver circuits are formed using, for example, CGS (Continuous Grain Silicon) on a liquid crystal panel 10 having the pixel array 1 formed thereon. Note that in FIG. 1, the control circuit 2 and the source driver circuit 3 are provided outside the liquid crystal panel 10, but all or part of these circuits may be formed on the liquid crystal panel 10.

The control circuit 2 generates timing control signals, supplies source voltage, and drives a common electrode. More specifically, the control circuit 2 supplies common electrode voltage VCOM to the common electrode of the pixel array 1, while supplying a timing control signal and a video signal to the source driver circuit 3. Furthermore, the control circuit 2 supplies two timing control signals (gate clock GCK and gate start pulse GSP) and two types of voltage (gate high voltage VGH and gate low voltage VGL) to the first and second gate driver circuits. The gate clock GCK changes in cycles of one line period (one horizontal period), and the gate start pulse GSP is brought into high level for one line period within one frame period. The gate high voltage VGH brings the TFT Q included in the pixel circuit P into ON state, while the gate low voltage VGL brings the TFT Q into OFF state.

The source driver circuit 3 drives the source lines S1 to Sm via dot-sequential drive, line-sequential drive, or the like, based on the timing control signal and the video signal supplied by the control circuit 2.

The first and second gate driver circuits cooperatively drive the gate lines G1 to Gn in accordance with the timing control signals supplied by the control circuit 2. The first gate driver circuit (the shift register 4 and the amplifier circuits 11) is positioned to the left of the pixel array 1 along the left side thereof, and connected to the left ends of the gate lines G1 to Gn. The second gate driver circuit (the shift register 5 and the amplifier circuits 12) is positioned to the right of the pixel array 1 along the right side thereof, and connected to the right ends of the gate lines G1 to Gn. In this manner, the first and second gate driver circuits are formed along two opposing sides of the pixel array 1 (two sides in the column direction) on the liquid crystal panel 10 having the pixel array 1 formed thereon.

Both the shift registers 4 and 5 sequentially shift the gate start pulse GSP in accordance with the gate clock GCK. The shift register 4 outputs n selection signals A1 to An, which are sequentially brought into high level for one line period. The shift register 5 outputs n selection signals B1 to Bn, which change in the same manner as the selection signals A1 to An. The i'th amplifier circuit 11 amplifies the selection signal Ai outputted from the i'th stage of the shift register 4 before application to the scanning signal line Gi. The i'th amplifier circuit 12 amplifies the selection signal Bi outputted from the i'th stage of the shift register 5 before application to the scanning signal line Gi.

The amplifier circuits 11 and 12 are each configured by connecting a plurality of switches in multiple stages. Hereinafter, the switch located in the last stage of the amplifier circuit is referred to as the "last-stage switch". The last-stage switch of the i'th amplifier circuit 11 is connected to the left end of the gate line Gi, and the last-stage switch of the i'th amplifier circuit 12 is connected to the right end of the gate line Gi.

The amplifier circuit 11 is configured by connecting three CMOS switches and one NMOS switch in multiple stages. The last-stage switch of the amplifier circuit 11 is the NMOS switch. The CMOS switch includes a PMOS switch and an NMOS switch that have a common drain. The (three) PMOS switches included in the amplifier circuit 11 each have a source terminal to which the gate high voltage VGH is applied, and the NMOS switches (four, including the last-stage switch) included in the amplifier circuit 11 each have a source terminal to which the gate low voltage VGL is applied.

The amplifier circuit 12 is configured by connecting three CMOS switches and one PMOS switch in multiple stages. The last-stage switch of the amplifier circuit 12 is the PMOS switch. The PMOS switches (four, including the last-stage switch) included in the amplifier circuit 12 each have a source terminal to which the gate high voltage VGH is applied, and the (three) NMOS switches included in the amplifier circuit 12 each have a source terminal to which the gate low voltage VGL is applied.

As for the four switches included in the amplifier circuit 11, 12, the drive capability increases toward the downstream, and the last-stage switch has sufficient capability to drive the gate line, G1 to Gn. Accordingly, for the switches, the transistor size increases toward the downstream. However, a transistor size significantly greater than that of the previous stage increases the gate parasitic capacitance of the transistor in the next stage, which in turn increases signal waveform rounding. Correspondingly, the period in which both the PMOS switch and the NMOS switch are in ON state is lengthened, resulting in increased current consumption. Therefore, the multiplication factor for the transistor size is limited to a specific value or lower (e.g., several times or less).

When the selection signals Ai and Bi are at high level, the last-stage switch of the i'th amplifier circuit 11 is brought into OFF state, and the last-stage switch of the i'th amplifier circuit 12 is brought into ON state. At this time, the gate line Gi is driven by the last-stage switch of the i'th amplifier circuit 12, and the gate high voltage VGH is applied to the gate line Gi.

On the other hand, when the selection signals Ai and Bi are at low level, the last-stage switch of the i'th amplifier circuit 11 is brought into ON state, and the last-stage switch of the i'th amplifier circuit 12 is brought into OFF state. At this time, the gate line Gi is driven by the last-stage switch of the i'th amplifier circuit 11, and the gate low voltage VGL is applied to the gate line Gi.

In this manner, in the liquid crystal display device according to the present embodiment, one of the last-stage switches of the i'th amplifier circuits 11 and 12 is brought into ON state, and the other into OFF state, in accordance with the selection signals Ai and Bi outputted by the shift registers 4 and 5, so that either the gate high voltage VGH or the gate low voltage VGL is applied to the gate line Gi. Thus, the liquid crystal display device according to the present embodiment allows the first and second gate driver circuits to drive the gate lines G1 to Gn.

Figure 2:
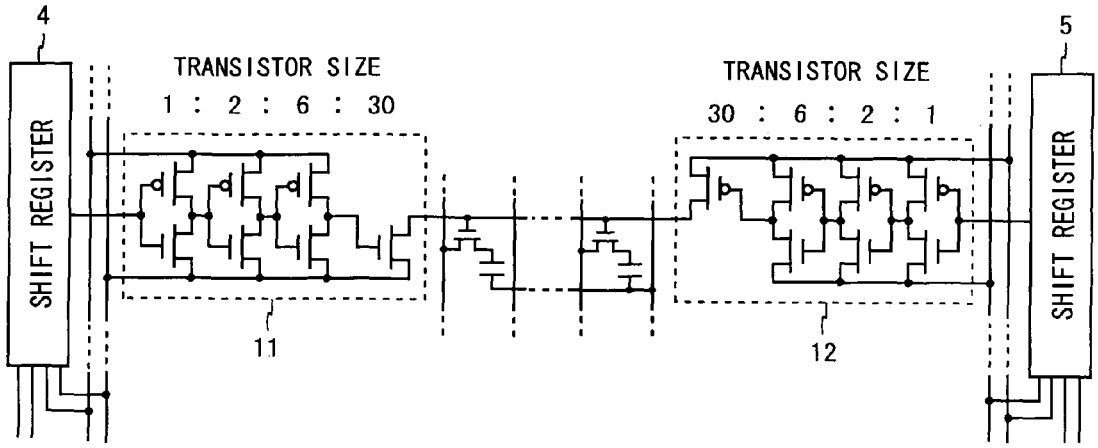
FIG. 2 is a diagram indicating transistor size ratios in amplifier circuits of the liquid crystal display device shown in FIG. 1.
Figure 3:
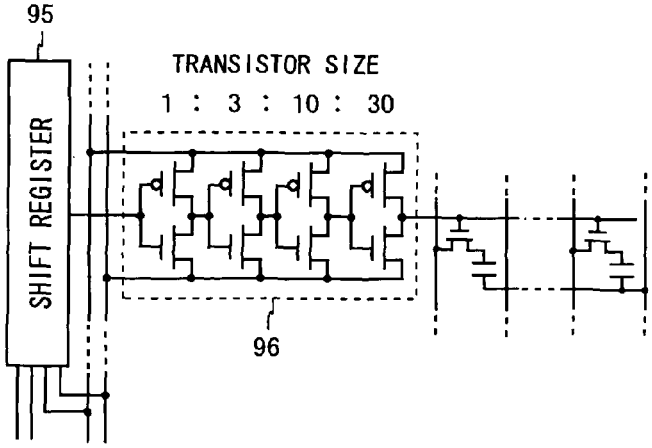
FIG. 3 is a diagram indicating a transistor size ratio in an amplifier circuit of a conventional liquid crystal display device.
Figure 14:
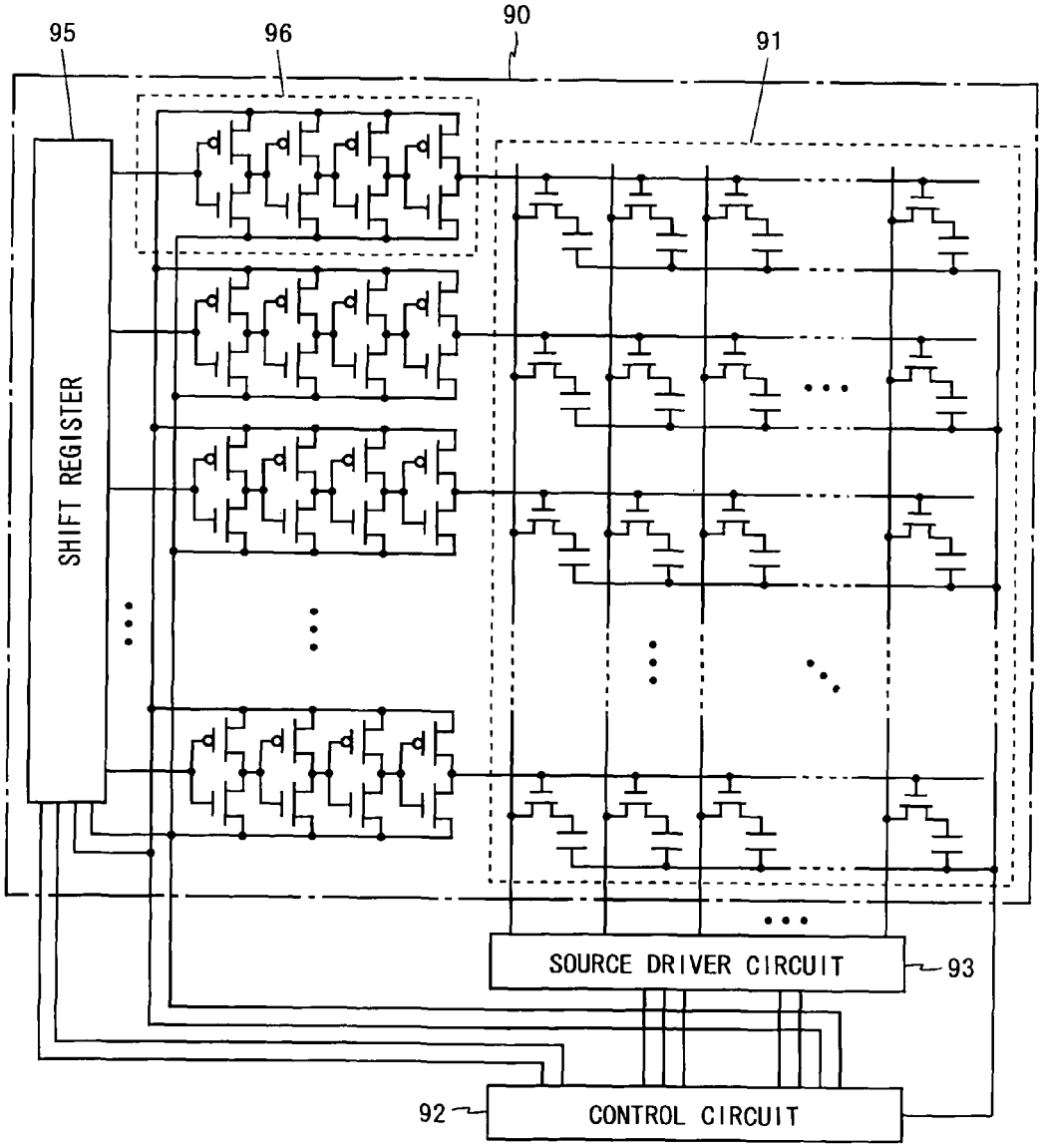
FIG. 14 is a diagram illustrating in detail a gate driver circuit of the liquid crystal display device shown in FIG. 13.
Figure 15:
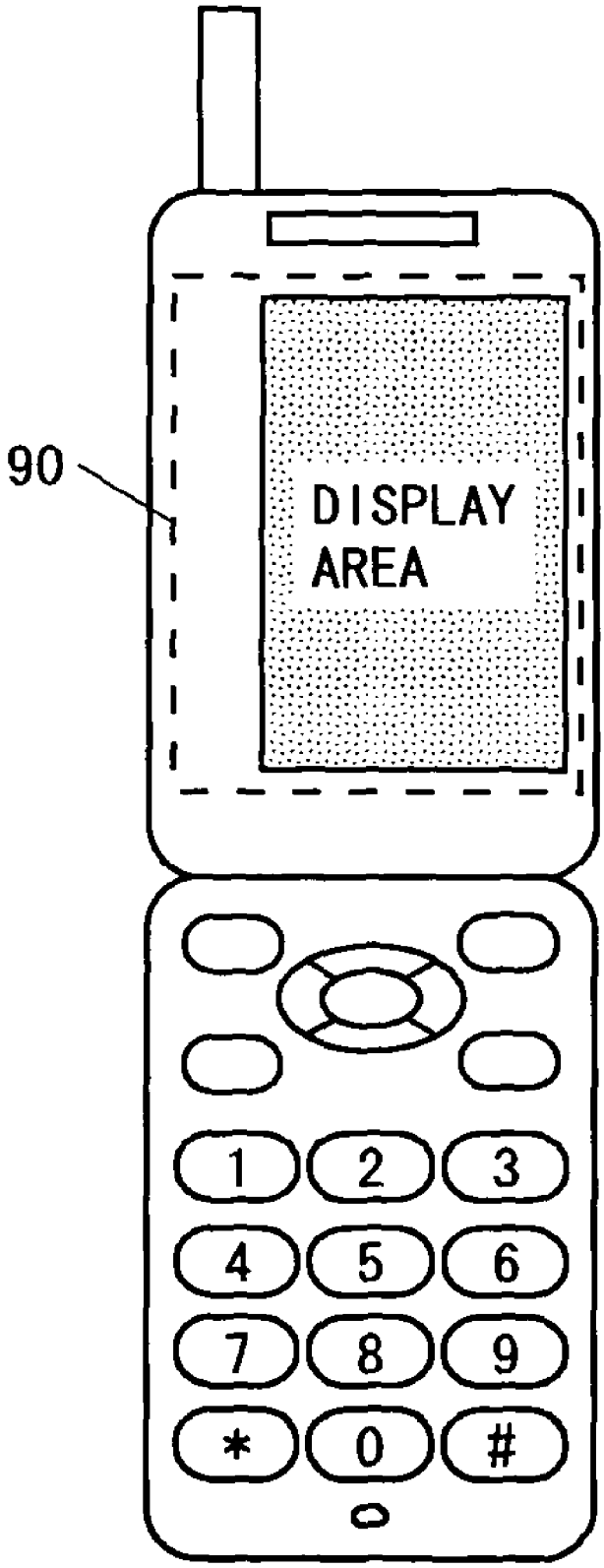
FIG. 15 is an external view of a cell phone using a liquid crystal panel with a left-right a symmetrical display area.

Effects of the liquid crystal display device according to the present embodiment will be described below. FIG. 2 is a diagram indicating transistor size ratios in the amplifier circuits 11 and 12. FIG. 3 is a diagram indicating a transistor size ratio in the amplifier circuit 96 of the conventional liquid crystal display device (FIG. 14).

Here, it is assumed that the last-stage switch is required to have a transistor size about thirty times the transistor size of the first-stage switch. In this case, in the amplifier circuit 96 of the conventional liquid crystal display device, the transistor size is required to be multiplied by about 3 in a stage-by-stage manner. As a result, the amplifier circuit 96 has a transistor size ratio of 1:3:10:30 (see FIG. 3) and a total transistor size of $(1+3+10+30)\times 2=88$.

On the other hand, in the liquid crystal display device according to the present embodiment, an NMOS switch and a PMOS switch are respectively provided in the last-stages of the amplifier circuits 11 and 12, and therefore the size of each last-stage switch is approximately halved compared to the case where a CMOS switch is provided. In addition, the switch in the first stage from the last is only required to drive a single-channel MOS switch, and therefore can be reduced in size compared to the case of driving a CMOS switch. For the same reason, the switch in the second stage from the last can be reduced in size. As a result, the amplifier circuits 11 and 12 have a transistor size ratio of, for example, 1:2:6:30 (see FIG. 2) and a total transistor size of $(1+2+6)\times 2+30=48$.

Assuming that conventional liquid crystal display devices have the shift register 95 and the amplifier circuit 96 that are almost equal in size (in practice, the amplifier circuit 96 is often slightly larger), the liquid crystal display device according to the present embodiment has the amplifier circuits 11 and 12 that are about half the conventional size (=48/88), so that the first and second gate driver circuits are about three quarters the conventional size. In this manner, the liquid crystal display device according to the present embodiment allows the last-stage switches in the first and second gate driver circuits to be reduced to about half the conventional size, while also reducing other switches in size.

Also, the first and second gate driver circuits are respectively positioned to the left and right of the pixel array 1 on the liquid crystal panel 10, and therefore the display area is rendered left-right symmetrical on the liquid crystal panel 10. Also, the last-stage switches of the amplifier circuits 11 and 12 are connected via the scanning signal line, G1 to Gn, having resistance and capacitive load, and therefore no through current flows even if both of the two last-stage switches connected to the opposite ends of the scanning signal line, G1 to Gn, are brought into ON state. Accordingly, it is possible to reduce current consumption more than conventionally.

As described above, the liquid crystal display device according to the present embodiment makes it possible to reduce the circuit complexity of the driver circuits formed on the liquid crystal panel, thereby reducing current consumption, while rendering the display area left-right symmetrical on the liquid crystal panel.

(Second Embodiment)

Figure 4:
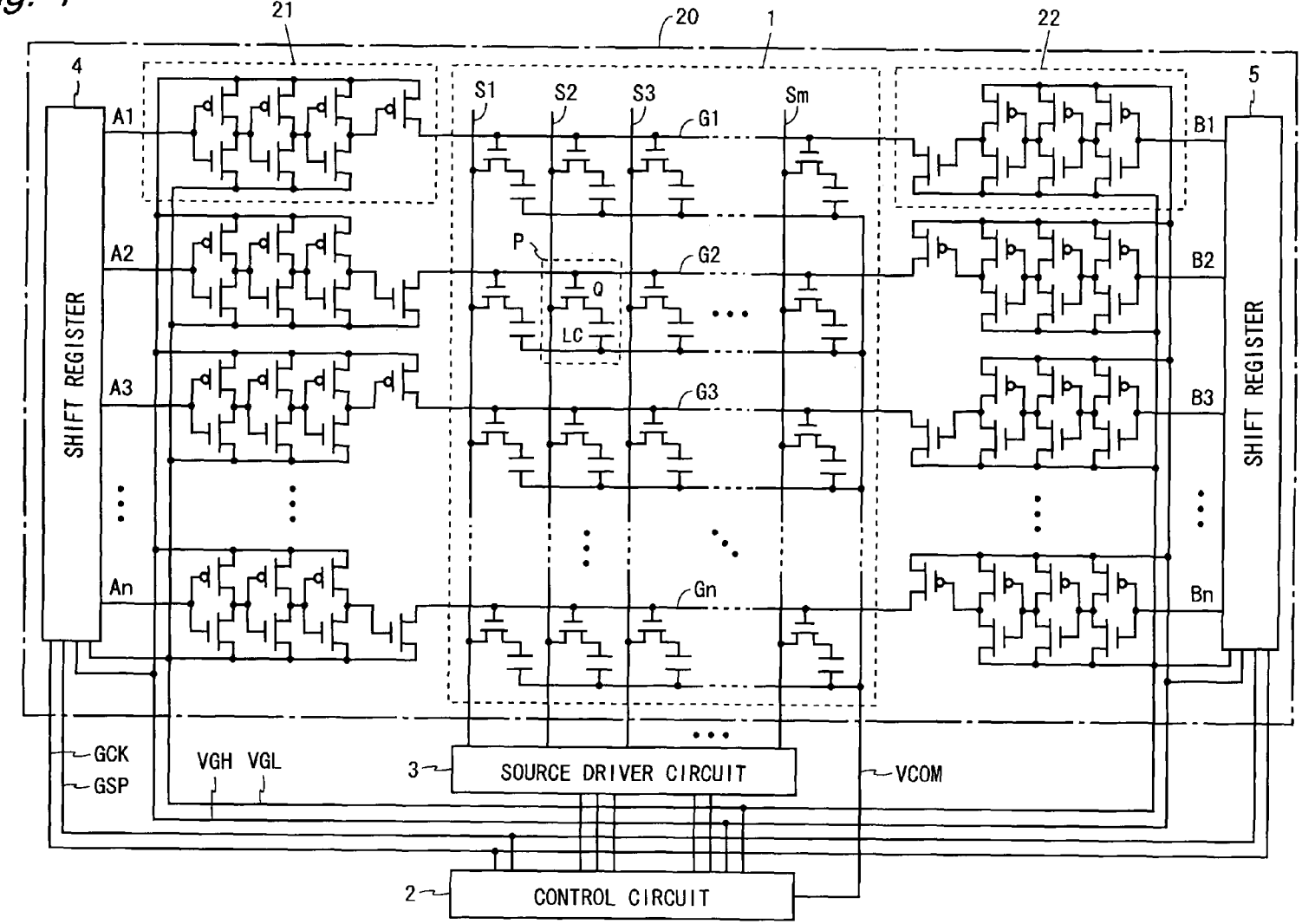
FIG. 4 is a diagram illustrating the configuration of a liquid crystal display device according to a second embodiment of the present invention.

FIG. 4 is a diagram illustrating the configuration of a liquid crystal display device according to a second embodiment of the present invention. The liquid crystal display device shown in FIG. 4 has amplifier circuits 21 and 22 in place of the amplifier circuits 11 and 12, respectively, in the liquid crystal display device according to the first embodiment (FIG. 1). In the present embodiment, the same elements as in the first embodiment are denoted by the same reference characters, and any descriptions thereof will be omitted (the same shall apply to embodiments below).

The amplifier circuits 21 and 22 are each configured by connecting three CMOS switches and one single-channel switch in multiple stages. An odd-numbered amplifier circuit 21 has a PMOS switch provided as the last-stage switch, and an even-numbered amplifier circuit 21 has an NMOS switch provided as the last-stage switch. Also, an odd-numbered amplifier circuit 22 has an NMOS switch provided as the last-stage switch, and an even-numbered amplifier circuit 22 has a PMOS switch provided as the last-stage switch. In this manner, PMOS and NMOS switches are alternately provided in the last-stages of the amplifier circuits 21 in accordance with the gate lines G1 to Gn, and PMOS and NMOS switches are alternately provided in the last-stages of the amplifier circuits 22 in reverse order to the amplifier circuits 21 in accordance with the gate lines G1 to Gn.

An odd-numbered gate line Gi is driven by the last-stage switch of the i'th amplifier circuit 21 when the selection signals Ai and Bi are at high level, and by the last-stage switch of the i'th amplifier circuit 22 when the selection signals Ai and Bi are at low level. An even-numbered gate line Gi is driven by the last-stage switch of the i'th amplifier circuit 22 when the selection signals Ai and Bi are at high level, and by the last-stage switch of the i'th amplifier circuit 21 when the selection signals Ai and Bi are at low level.

The liquid crystal display device according to the present embodiment allows the last-stage switches in the first and second gate driver circuits to be reduced to about half the conventional size, while also reducing other switches in size, as in the liquid crystal display device according to the first embodiment.

Also, the odd-numbered gate lines and the even-numbered gate lines are driven differently, so that the waveforms of the gate lines can be averaged. Also, current consumption can be averaged between the first and second gate driver circuits.

(Third Embodiment)

Figure 5:
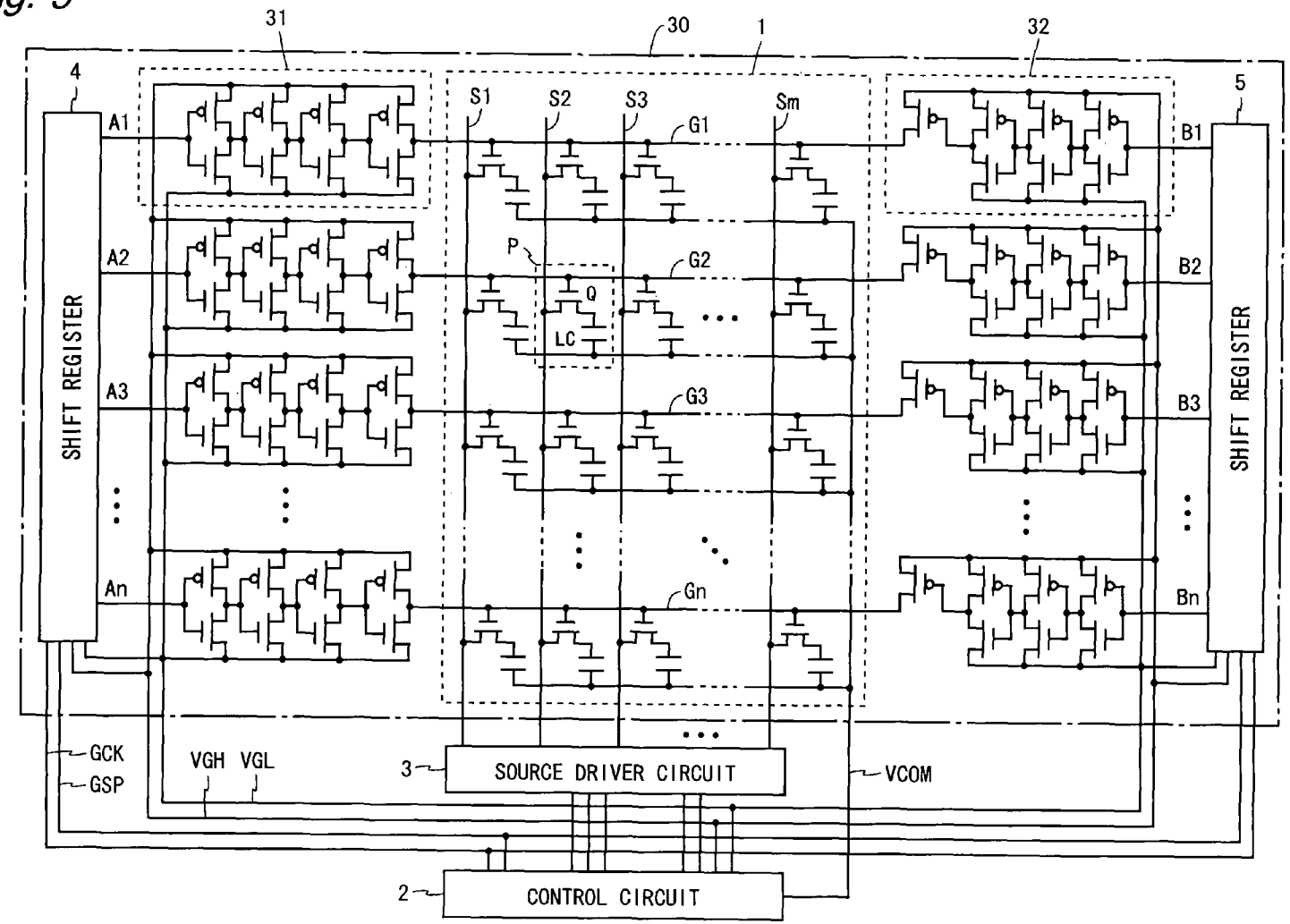
FIG. 5 is a diagram illustrating the configuration of a liquid crystal display device according to a third embodiment of the present invention.

FIG. 5 is a diagram illustrating the configuration of a liquid crystal display device according to a third embodiment of the present invention. The liquid crystal display device shown in FIG. 5 has amplifier circuits 31 and 32 in place of the amplifier circuits 11 and 12, respectively, in the liquid crystal display device according to the first embodiment (FIG. 1). The amplifier circuits 31 are each configured by connecting four CMOS switches in multiple stages. The last-stage switches of the amplifier circuits 31 are CMOS switches. The amplifier circuits 32 are each configured by connecting three CMOS switches and one PMOS switch in multiple stages. The last-stage switches of the amplifier circuits 32 are PMOS switches.

When the selection signals Ai and Bi are at high level, a PMOS switch and an NMOS switch in the last-stage switch of the i'th amplifier circuit 31 are brought into ON and OFF states, respectively, and the last-stage switch of the i'th amplifier circuit 32 is brought into ON state. At this time, the gate line Gi is driven by two PMOS switches, and the gate high voltage VGH is applied to the gate line Gi.

On the other hand, when the selection signals Ai and Bi are at low level, the PMOS switch and NMOS switch in the last-stage switch of the i'th amplifier circuit 31 are brought into OFF and ON states, respectively, and the last-stage switch of the i'th amplifier circuit 32 is brought into OFF state. At this time, the gate line Gi is driven by one NMOS switch, and the gate low voltage VGL is applied to the gate line Gi.

The liquid crystal display device according to the present embodiment allows each last-stage switch in the second gate driver circuit to be approximately halved in size compared to the case where a CMOS switch is provided, while also allowing switches other than in the last stage to be reduced in size. Also, given the presence of the second gate driver circuit, the switches included in the first gate driver circuit can be reduced in size.

Also, by suitably determining the size of two switches to be included in the last-stage switch of each amplifier circuit 31 and the size of the last-stage switch of each amplifier circuit 32 (e.g., by approximately equalizing the three switches in size), the rising waveforms of the gate lines G1 to Gn can be rendered steeper than their falling waveforms.

Also, by approximately equalizing the size of the NMOS switch included in the last-stage switch of each amplifier circuit 31 with the sum of the size of the PMOS switch included in the last-stage switch of the amplifier circuit 31 and the size of the last-stage switch of each amplifier circuit 32, the rising and falling waveforms of the gate lines G1 to Gn can be approximately equalized in shape.

(Fourth Embodiment)

Figure 6:
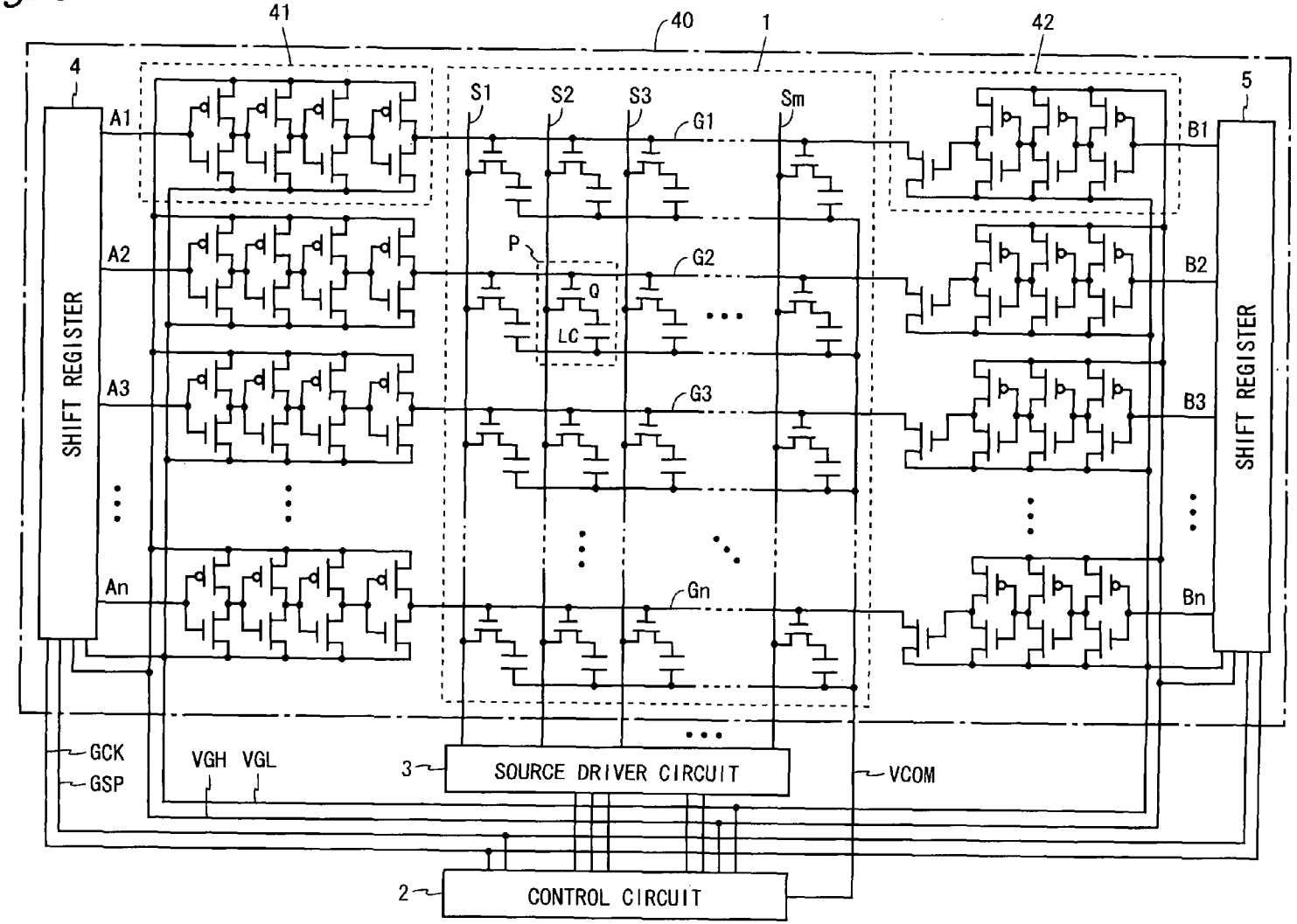
FIG. 6 is a diagram illustrating the configuration of a liquid crystal display device according to a fourth embodiment of the present invention.

FIG. 6 is a diagram illustrating the configuration of a liquid crystal display device according to a fourth embodiment of the present invention. The liquid crystal display device shown in FIG. 6 has amplifier circuits 41 and 42 in place of the amplifier circuits 11 and 12, respectively, in the liquid crystal display device according to the first embodiment (FIG. 1). The amplifier circuits 41 are each configured by connecting four CMOS switches in multiple stages. The last-stage switches of the amplifier circuits 41 are CMOS switches. The amplifier circuits 42 are each configured by connecting three CMOS switch and one NMOS switch in multiple stages. The last-stage switches of the amplifier circuits 42 are NMOS switches. The operation of the last-stage switch is the same as that in the third embodiment, and therefore any description thereof will be omitted here.

The liquid crystal display device according to the present embodiment makes it possible to reduce the circuit complexity of the first and second gate driver circuits, as in the liquid crystal display device according to the third embodiment. Also, by suitably determining the size of three switches to be connected to the gate line, G1 to Gn, the falling waveform of the gate line, G1 to Gn, can be rendered steeper than its rising waveform, thereby allowing early rising of the next gate line. Also, by approximately equalizing the size of the PMOS switch, included in the last-stage switch of each amplifier circuit 41 with the sum of the size of the NMOS switch included in the last-stage switch of the amplifier circuit 41 and the size of the last-stage switch of each amplifier circuit 42, the rising and falling waveforms of the gate lines G1 to Gn can be approximately equalized in shape.

(Fifth Embodiment)

Figure 7:
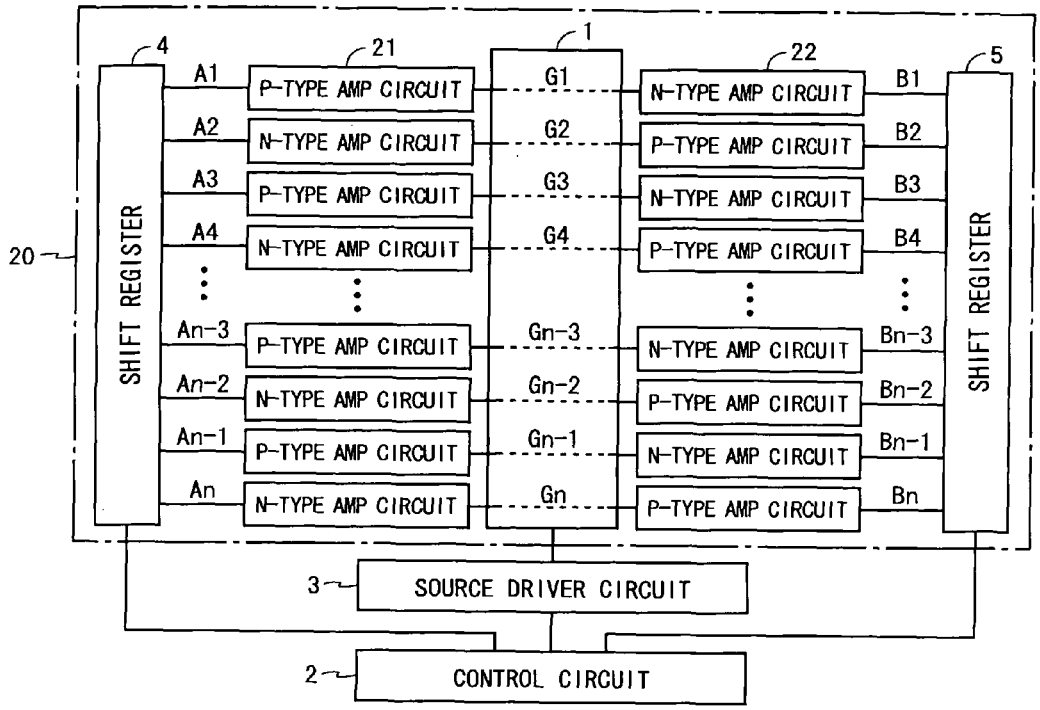
FIG. 7 is a block diagram providing a simplified representation of the liquid crystal display device shown in FIG. 4.

A fifth embodiment will be described with respect to various liquid crystal display devices to which generalized features of the second embodiment are applied. FIG. 7 is a block diagram providing a simplified representation of the liquid crystal display device according to the second embodiment of the present invention (FIG. 4). FIGS. 8 to 12 are block diagrams providing similar representations of first through fifth examples of a liquid crystal display device according to a fifth embodiment of the present invention. In FIGS. 7 to 12, amplifier circuits having a PMOS switch provided in their last stages are labeled "P-channel amp circuit", amplifier circuits having an NMOS switch provided in their last stages are labeled "N-channel amp circuit", and amplifier circuits having a CMOS switch provided in their last stages are labeled "C-channel amp circuit". Also, wirings for supplying the gate high voltage VGH, the gate low voltage VGL, and the common electrode voltage VCOM are omitted, and a plurality of lines are represented by one line segment or broken line.

In the liquid crystal display device according to the second embodiment, the amplifier circuits 21 and 22 have PMOS and NMOS switches alternately provided one by one in their last stages in accordance with the gate lines G1 to Gn. Instead of this, PMOS and NMOS switches are alternately provided two by two in accordance with the order of arrangement of the gate lines G1 to Gn, thereby configuring the liquid crystal display device shown in FIG. 8. In the liquid crystal panel 51 shown in FIG. 8, PMOS and NMOS switches are alternately provided two by two in the last stages of the amplifier circuits 61 in accordance with the order of arrangement of the gate lines G1 to Gn, while PMOS and NMOS switches are alternately provided two by two in the last stages of the amplifier circuits 62 in reverse order to the amplifier circuits 61.

Figure 9:
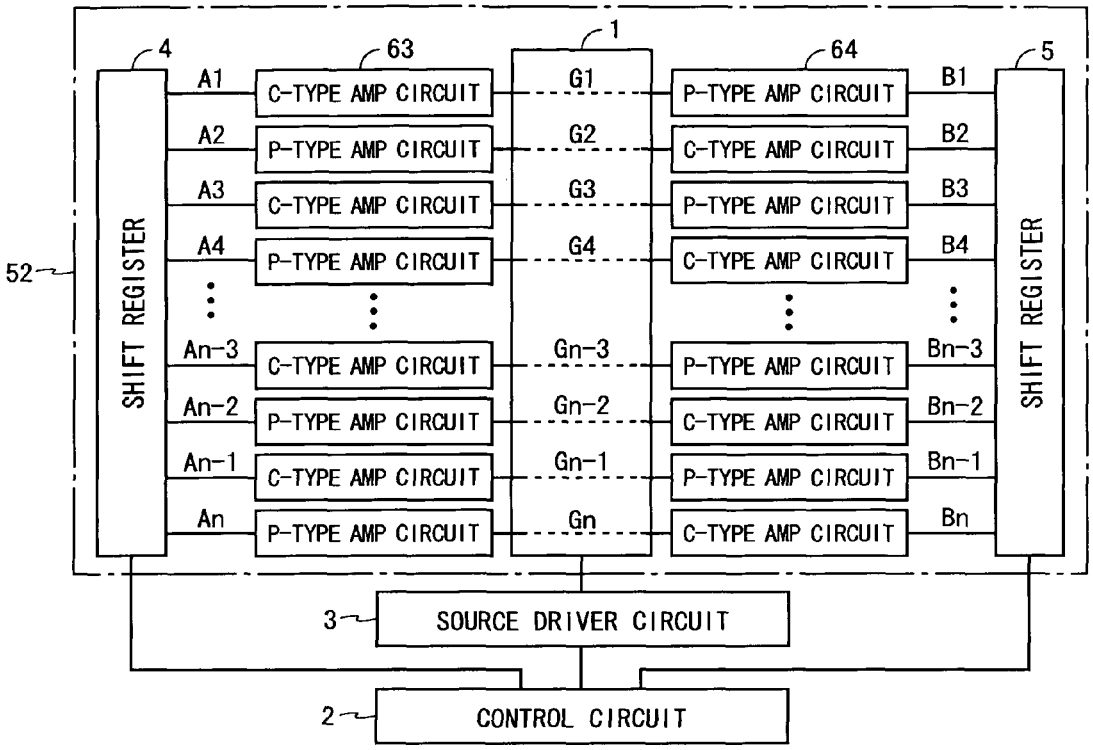
FIG. 9 is a block diagram illustrating the configuration of a liquid crystal display device (second example) according to the fifth embodiment of the present invention.
Figure 10:
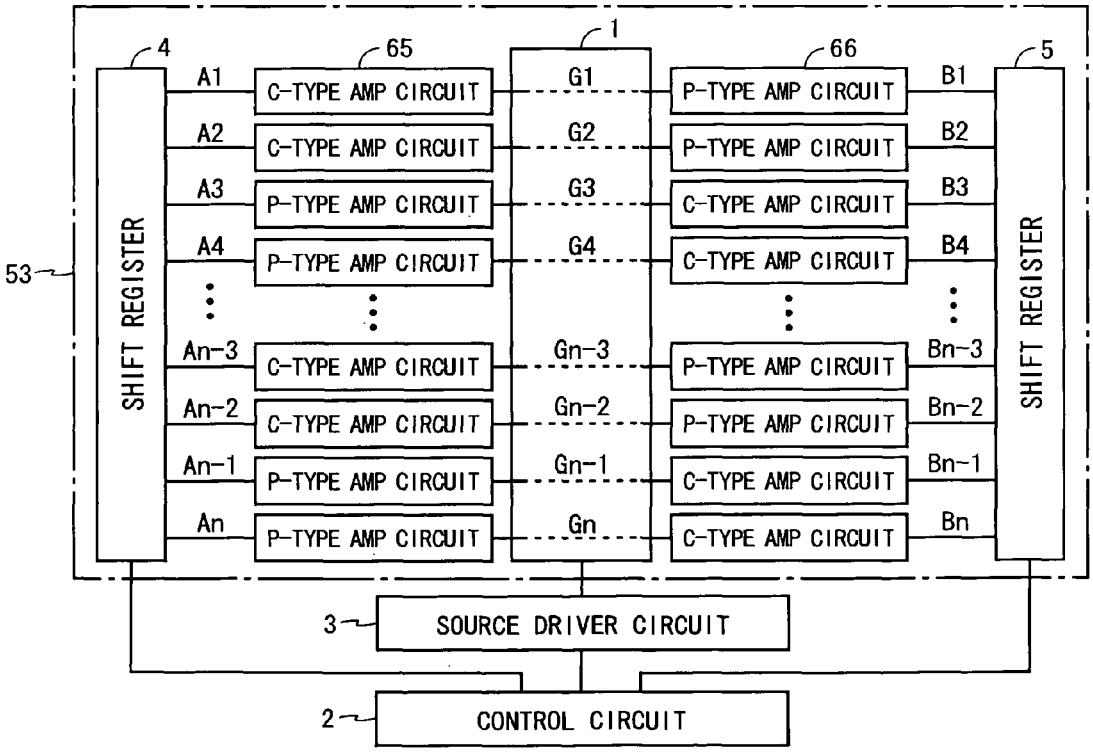
FIG. 10 is a block diagram illustrating the configuration of a liquid crystal display device (third example) according to the fifth embodiment of the present invention.

Also, providing CMOS and PMOS switches instead of the PMOS and NMOS switches makes it possible to configure the liquid crystal display devices shown in FIGS. 9 and 10. In the liquid crystal panel 52 shown in FIG. 9, CMOS and PMOS switches are alternately provided one by one in the last stages of the amplifier circuits 63 in accordance with the order of arrangement of the gate lines G1 to Gn, while CMOS and PMOS switches are alternately provided one by one in the last stages of the amplifier circuits 64 in reverse order to the amplifier circuits 63. In the liquid crystal panel 53 shown in FIG. 10, CMOS and PMOS switches are alternately provided two by two in the last stages of the amplifier circuits 65 in accordance with the order of arrangement of the gate lines G1 to Gn, while CMOS and PMOS switches are alternately provided two by two in the last stages of the amplifier circuits 66 in reverse order to the amplifier circuits 65.

Figure 11:
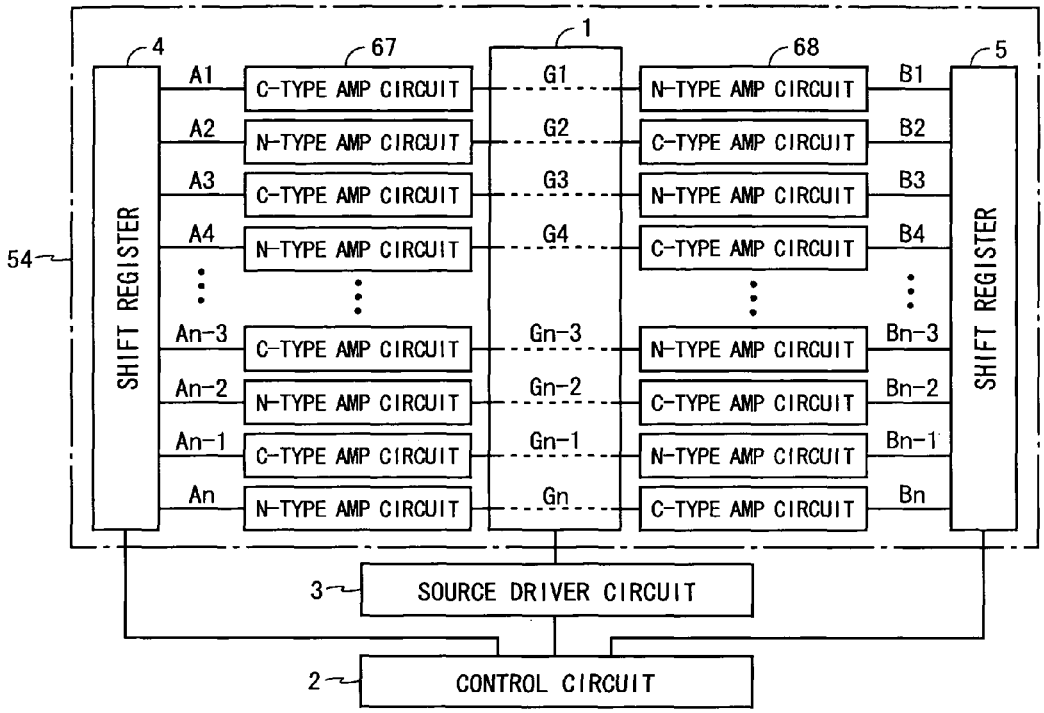
FIG. 11 is a block diagram illustrating the configuration of a liquid crystal display device (fourth example) according to the fifth embodiment of the present invention.
Figure 12:
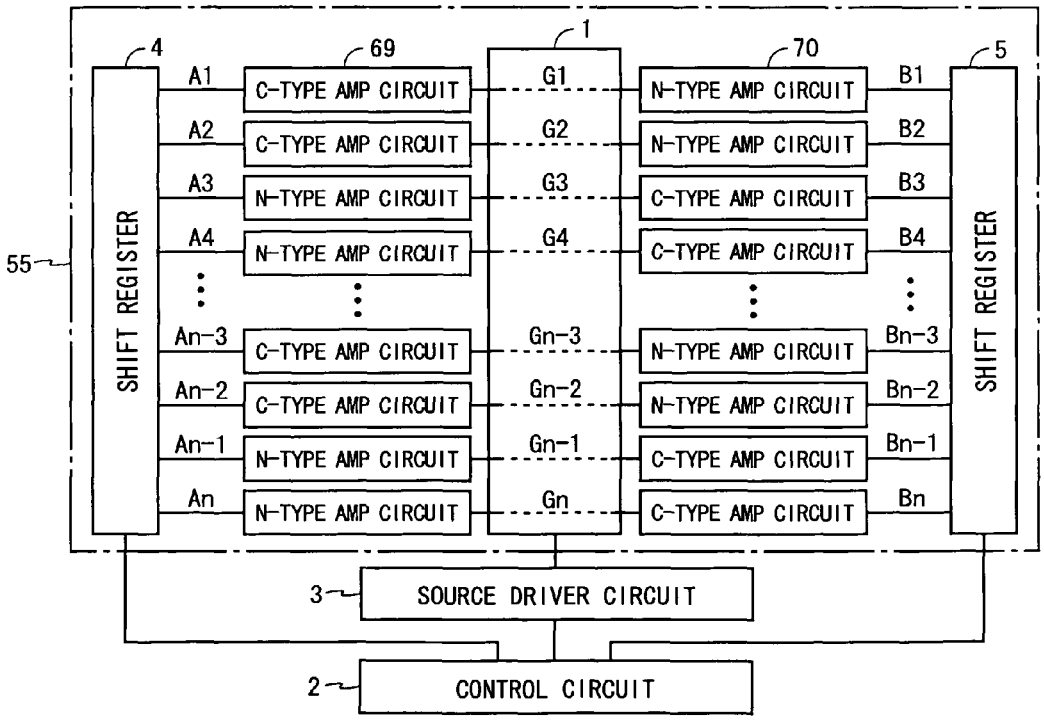
FIG. 12 is a block diagram illustrating the configuration of a liquid crystal display device (fifth example) according to the fifth embodiment of the present invention.
Figure 13:
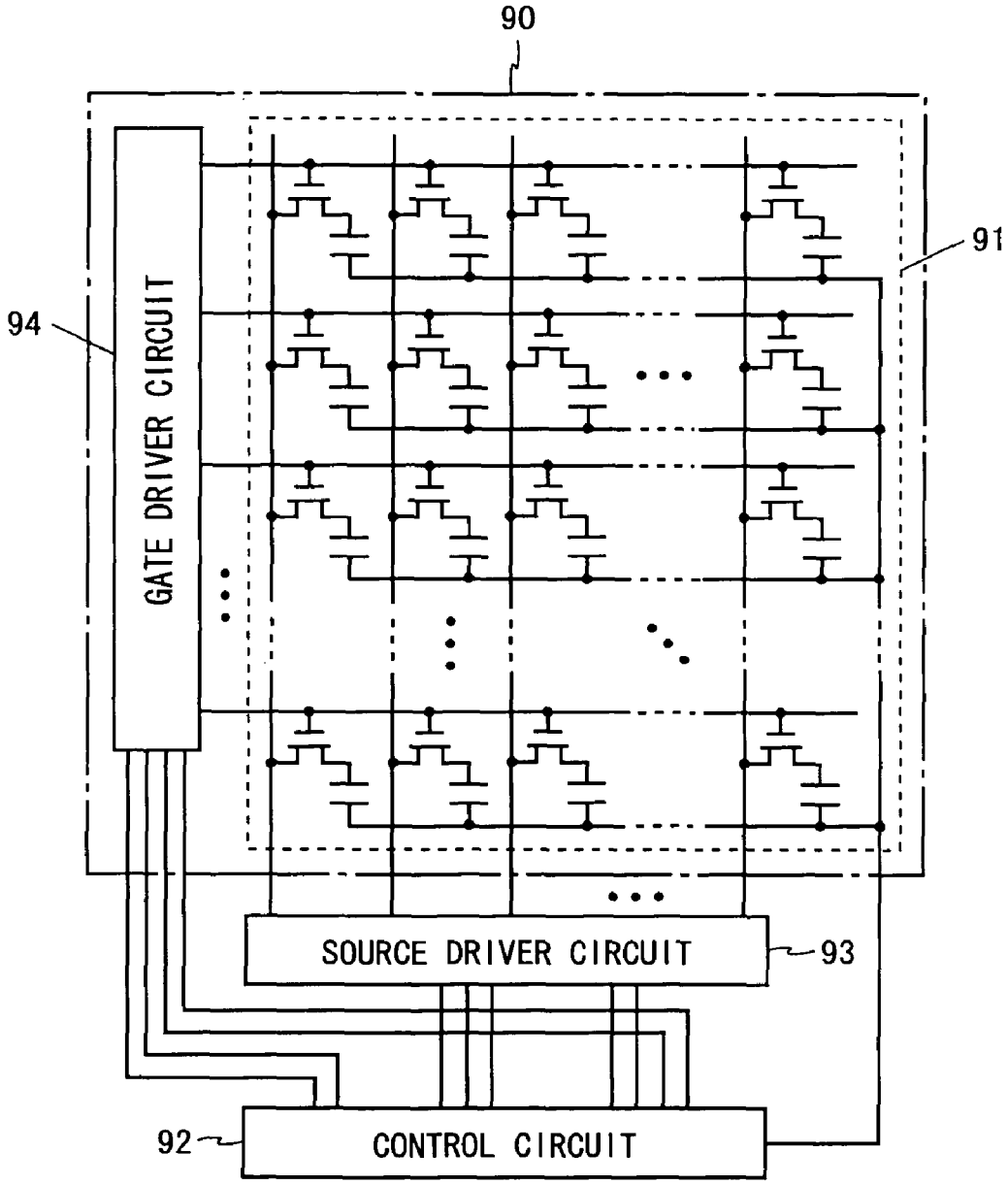
FIG. 13 is a diagram illustrating the configuration of a conventional liquid crystal display device.

Also, providing CMOS and NMOS switches makes it possible to configure the liquid crystal display devices shown in FIGS. 11 and 12. In the liquid crystal panel 54 shown in FIG. 11, CMOS and NMOS switches are alternately provided one by one in the last stages of the amplifier circuits 67 in accordance with the order of arrangement of the gate lines G1 to Gn, while CMOS and NMOS switches are alternately provided one by one in the last stages of the amplifier circuits 68 in reverse order to the amplifier circuits 67. In the liquid crystal panel 55 shown in FIG. 12, CMOS and NMOS switches are alternately provided two by two in the last stages of the amplifier circuits 69 in accordance with the order of arrangement of the gate lines G1 to Gn, while CMOS and NMOS switches are alternately provided two by two in the last stages of the amplifier circuits 70 in reverse order to the amplifier circuits 69.

Figure 8:
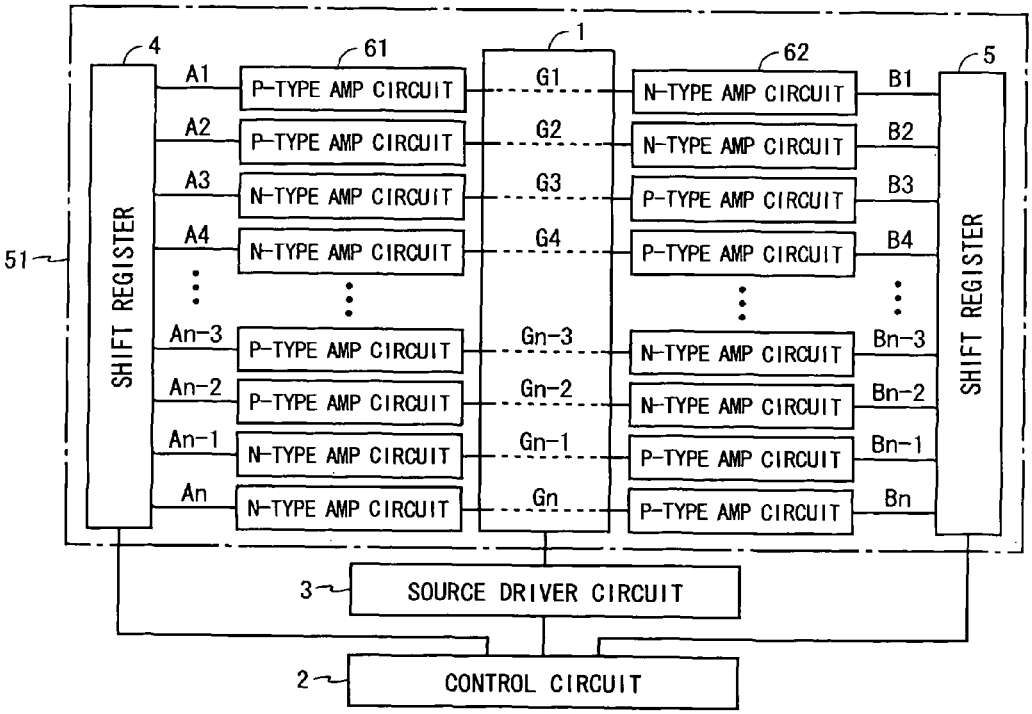
FIG. 8 is a block diagram illustrating the configuration of a liquid crystal display device (first example) according to a fifth embodiment of the present invention.

In general, PMOS and NMOS switches may be alternately provided k by k (where k is an integer of 1 or more) in the last stages of the amplifier circuits arranged along one side of the pixel array 1 in accordance with the order of arrangement of the gate lines G1 to Gn, whereas PMOS and NMOS switches may be alternately provided k by k in the last stages of the amplifier circuits arranged along the other side of the pixel array 1 in reverse order to their opposing amplifier circuits (FIGS. 7 and 8). Also, instead of so providing the PMOS and NMOS switches, CMOS and PMOS switches (FIGS. 9 and 10) or CMOS and NMOS switches (FIGS. 11 and 12) may be provided. The above value k may be 1 (FIGS. 7, 9, and 11), 2 (FIGS. 8, 10, and 12), or 3 or more.

The liquid crystal display devices thus configured make it possible to reduce the circuit complexity of the last-stage switches in the first and second gate driver circuits to about half the conventional complexity, while also reducing the circuit complexity of other switches. Also, by alternately arranging gate lines respectively having a steeply rising waveform and a steeply falling waveform k by k, it becomes possible to average the waveforms of the gate lines G1 to Gn. Also, it is possible to average current consumption between the first and second gate driver circuits.

Also, in the case of liquid crystal display devices with varying common electrode voltage VCOM, the common electrode voltage VCOM can be changed in cycles based on the number k, thereby improving image quality on the display screen. For example, when k=2, the common electrode voltage VCOM can be changed line by line, thereby improving image quality on the display screen. Also, when k=2, image quality on the display screen can be improved where two lines are selected simultaneously in liquid crystal display devices with a double-size display function.

Also, in the case where CMOS and PMOS switches are provided, the size of an NMOS switch included in the CMOS switch may be approximately equalized to the sum of the size of a PMOS switch included in the CMOS switch and the size of the singly used PMOS switch. In the case where CMOS and NMOS switches are provided, the size of a PMOS switch included in the CMOS switch may be approximately equalized to the sum of the size of an NMOS switch included in the CMOS switch and the size of the singly used NMOS switch. As a result, the rising and falling waveforms of the gate lines G1 to Gn can be approximately equalized in shape.

While the first through fifth embodiments have been described with respect to the liquid crystal display device as an example of the display device, display devices other than the liquid crystal display device (e.g., organic electroluminescence display device) can be configured by a similar method.

As described above, the display device of the present invention has driver circuits arranged in a well-balanced manner so that, although the overall driver circuit size slightly increases, no through current flows in the largest transistor, making it possible to reduce current consumption, while rendering the display area left-right symmetrical as necessary. Thus, it is possible to reduce the size of display devices for use in equipment that requires left-right balance, and increase the screen size while maintaining the equipment in the same size as conventional, or reduce the equipment in size while maintaining the same screen size as conventional. Also, the battery size can be reduced in accordance with a reduction in display device current consumption, making it possible to increase the degree of freedom in mobile equipment design.

Industrial Applicability

The display device of the present invention is characterized in that driver circuits can be arranged in a well-balanced manner, thereby reducing power consumption, and rendering the display area left-right symmetrical, and therefore can be used for various matrix-type display devices such as liquid crystal display devices and organic electroluminescence display devices.

The invention claimed is:

1. A matrix-type display device comprising:

a pixel array including a plurality of two-dimensionally arranged pixel circuits, a plurality of scanning signal lines, and a plurality of video signal lines;

a first scanning signal line driver circuit connected to one end of each of the scanning signal lines and driving the scanning signal lines;

a second scanning signal line driver circuit connected to the other ends of the scanning signal lines and cooperating with the first scanning signal line driver circuit to drive the scanning signal lines; and a video signal line driver circuit for driving the video signal lines, wherein, the first and second scanning signal line driver circuits each include a shift register for outputting selection signals for the scanning signal lines, and a plurality of amplifier circuits configured by connecting a plurality of switches in multiple stages, the amplifier circuits amplifying and applying the outputs from the shift register to the scanning signal lines, the first and second scanning signal line driver circuits respectively have only a single first and second switch provided in a last stage of their amplifier circuits, at least one of the first and second switches being an NMOS switch or a PMOS switch, and PMOS and NMOS switches are alternately provided as the first switches in accordance with the order of arrangement of the scanning signal lines, such that each switch is repeated a predetermined number of times before alternating with the other, and PMOS and NMOS switches are alternately provided as the second switches in reverse order to the first switches, such that each switch is repeated the predetermined number of times before alternating with the other.

2. The display device according to claim 1, wherein a size of the NMOS switch alternately provided as the first switch is approximately equal to a sum of a size of the PMOS switch alternately provided as the first switch and a size of the second switch.

3. The display device according to claim 1, wherein a size of the PMOS switch alternately provided as the first switch is approximately equal to a sum of a size of the NMOS switch alternately provided as the first switch and a size of the second switch.

4. The display device according to claim 1, wherein the first and second scanning signal line driver circuits are formed along two opposing sides of the pixel array on a display panel having the pixel array formed thereon.

5. The display device according to claim 1, wherein the predetermined number is 1.

6. The display device according to claim 1, wherein the predetermined number is 2.

7. A matrix-type display device comprising:

a pixel array including a plurality of two-dimensionally arranged pixel circuits, a plurality of scanning signal lines, and a plurality of video signal lines;

a first scanning signal line driver circuit connected to one end of each of the scanning signal lines and driving the scanning signal lines;

a second scanning signal line driver circuit connected to the other ends of the scanning signal lines and cooperating with the first scanning signal line driver circuit to drive the scanning signal lines; and a video signal line driver circuit for driving the video signal lines, wherein, the first and second scanning signal line driver circuits each include a shift register for outputting selection signals for the scanning signal lines, and a plurality of amplifier circuits configured by connecting a plurality of switches in multiple stages, the amplifier circuits amplifying and applying the outputs from the shift register to the scanning signal lines, the first and second scanning signal line driver circuits respectively have only a single first and second switch provided in a last stage of their amplifier circuits, at least one of the first and second switches being an NMOS switch of a PMOS switch, and CMOS and PMOS switches are alternately provided as the first switches in accordance with the order of arrangement of the scanning signal lines, such that each switch is repeated a predetermined number of times before alternating with the other, and CMOS and PMOS switches are alternately provided as the second switches in reverse order to the first switches, such that each switch is repeated the predetermined number of times before alternating with the other.

8. The display device according to claim 7, wherein the predetermined number is 1.

9. The display according to claim 7, wherein the predetermined number is 2.

10. The display device according to claim 7, wherein the size of an NMOS switch included in each of the CMOS switches provided as the first and second switches is approximately equal to the sum of the size of a PMOS switch included in the CMOS switch and the size of each of the PMOS switches provided as the first and second switches.

11. A matrix-type display device comprising:

a pixel array including g a plurality of two-dimensionally arranged pixel circuits, a plurality of scanning signal lines, and a plurality of video signal lines;

a first scanning signal line drier circuit connected to one end of each of the scanning signal lines and driving the scanning signal lines;

a second scanning signal line driver circuit connected to the other ends of the scanning signal lines and cooperating with the first scanning signal line driver circuit to drive the scanning signal lines; and a video signal line driver circuit for driving the video signal lines, wherein, the first and second scanning signal line driver circuits each include a shift register for outputting selection signals for the scanning signal lines, and a plurality of amplifier circuits configured by connecting a plurality of switches in multiple stages, the amplifier circuits amplifying and applying the outputs from the shift register to the scanning signal lines, the first and second scanning signal line driver circuits respectively have only a single first and second switch provided in a last stage of thief amplifier circuits, at least one of the first and second switches being and NMOS switch or a PMOS switch, and CMOS and NMOS switches are alternately provided as the first switches in accordance with the order of arrangement of the scanning signal lines, such that each switch is repeated a predetermined number of times before alternating with the other, and CMOS and NMOS switches are alternately provided as the second switches in reverse order to the first switches, such that each switch is repeated the predetermined number of times before alternating with the other.

12. The display device according to claim 11, wherein the predetermined number is 1.

13. The display device according to claim 11, wherein the predetermined number is 2.

14. The display device according to claim 11, wherein the size of a PMOS switch included in each of the CMOS switches provided as the first and second switches is approximately equal to the sum of the size of an NMOS switch included in the CMOS switch and the size of each of the NMOS switches provided as the first and second switches.

* * * * *